US011786801B2

(12) United States Patent
Gayton et al.

(10) Patent No.: US 11,786,801 B2
(45) Date of Patent: Oct. 17, 2023

(54) NIGHT LIFE GEAR

(71) Applicants: Karen L. Gayton, Gainesville, GA (US); William E. Gayton, Gainesville, GA (US); Jacob H. Gayton, Gainesville, GA (US)

(72) Inventors: Karen L. Gayton, Gainesville, GA (US); William E. Gayton, Gainesville, GA (US); Jacob H. Gayton, Gainesville, GA (US)

( * ) Notice: Subject to any disclaimer, the term of this patent is extended or adjusted under 35 U.S.C. 154(b) by 0 days.

(21) Appl. No.: 17/367,241

(22) Filed: Jul. 2, 2021

(65) Prior Publication Data

US 2022/0003403 A1 Jan. 6, 2022

Related U.S. Application Data

(60) Provisional application No. 63/047,911, filed on Jul. 2, 2020.

(51) Int. Cl.

| | |
|---|---|
| ***F21V 33/00*** | (2006.01) |
| ***A63C 11/00*** | (2006.01) |
| ***B63B 45/04*** | (2006.01) |
| ***A63B 43/06*** | (2006.01) |
| ***B63C 9/20*** | (2006.01) |

(52) U.S. Cl.

CPC ..... *A63C 11/003* (2013.01); *A63B 43/06* (2013.01); *A63B 2225/74* (2020.08); *A63C 2203/14* (2013.01); *B63B 45/04* (2013.01); *B63C 9/20* (2013.01); *F21V 33/008* (2013.01)

(58) Field of Classification Search

CPC ... B63B 45/04; A63C 2203/14; A63C 11/003; A63B 2225/74

See application file for complete search history.

(56) References Cited

U.S. PATENT DOCUMENTS

| | | | | | |
|---|---|---|---|---|---|
| 4,837,494 | A * | 6/1989 | Maier | A43B 3/35 | 36/2.6 |
| 4,991,066 | A * | 2/1991 | McCowan | B60Q 1/34 | 362/540 |
| 4,997,196 | A * | 3/1991 | Wood | A63C 17/01 | 362/486 |
| 5,132,883 | A * | 7/1992 | La Lumandier | A63C 17/26 | 362/543 |
| 5,513,080 | A * | 4/1996 | Magle | B60Q 1/326 | 362/253 |
| 6,802,636 | B1 * | 10/2004 | Bailey, Jr. | A63C 17/26 | 362/555 |
| 7,942,450 | B2 * | 5/2011 | Kawano | A63C 11/003 | 280/816 |

(Continued)

FOREIGN PATENT DOCUMENTS

| | | | | |
|---|---|---|---|---|
| DE | 102014109945 A1 * | 1/2016 | ..... | A63C 17/26 |
| DE | 202018002500 U1 * | 7/2019 | | |

(Continued)

*Primary Examiner* — Alexander K Garlen

(74) *Attorney, Agent, or Firm* — Lainie E. Parker

(57) ABSTRACT

Light-up and/or glowing gear comprising: at least one item of gear; and any device or mechanism to light up or glow, e.g., at least one light, lighting system and/or glowing device, etc. The at least one light, lighting system and/or glowing device being permanently or reversibly attached to the at least one item of gear.

18 Claims, 5 Drawing Sheets

(56) References Cited

U.S. PATENT DOCUMENTS 8,038,313 B1 * 10/2011 Campbell ..... F21V 33/008 362/183
8,083,238 B2 * 12/2011 Borges ..... A63C 17/26 362/555
8,469,569 B1 * 6/2013 Tunnicliffe ..... A63C 17/015 362/545
8,777,442 B2 * 7/2014 Khan ..... F21V 33/008 362/183
8,814,403 B2 * 8/2014 Khan ..... F21V 33/008 362/183
9,694,883 B1 * 7/2017 Bonventre ..... B63B 59/02
9,943,749 B2 * 4/2018 Cerboneschi ..... A63C 17/26
10,060,591 B2 * 8/2018 Voaklander ..... F21S 4/26
10,161,623 B2 * 12/2018 Martinangeli ..... B63B 32/50
11,027,187 B2 * 6/2021 Rautiainen ..... B32B 3/18
2005/0029767 A1 * 2/2005 Chang ..... A63C 17/223 280/87.042
2007/0194558 A1 * 8/2007 Stone ..... A63C 17/26 280/601
2009/0067187 A1 * 3/2009 Jaime, Sr. ..... A63C 17/26 362/544
2011/0309772 A1 * 12/2011 Forgey ..... G09F 13/18 315/307
2012/0013094 A1 * 1/2012 Golden-Justice ..... A63C 17/01 280/87.042
2014/0191885 A1 * 7/2014 Dauphin ..... B63B 45/00 340/985
2015/0076781 A1 * 3/2015 O'Dea ..... A63C 17/017 264/154
2019/0091554 A1 * 3/2019 Rautiainen ..... B32B 5/02

FOREIGN PATENT DOCUMENTS

KR 101481714 B1 * 1/2015
KR 20160046363 A * 4/2016
KR 101655386 B1 * 9/2016

* cited by examiner

NIGHT LIFE GEAR

PRIORITY DATA

This application claims priority to, and incorporates in reference by its entirety, U.S. Provisional Application No. 63/047,911, filed Jul. 2, 2020, entitled NIGHT LIFE SAFETY GEAR.

FIELD OF THE INVENTION

The invention is in the newly invented field of gear with lights, such gear includes, but is not limited to, sports gear, safety gear, etc.

BACKGROUND OF THE INVENTION

The present invention involves increasing fun and safety during activities at night or at other times when light is scarce or visibility is otherwise decreased.

SUMMARY OF THE INVENTION

The present invention seeks to provide a solution by employing light up and/or glowing devices for any or all items used in during sports at night or at times of low visibility. This will allow the sports player to easily be spotted at night to avoid getting hurt due to being unseen.

One embodiment of the invention is light-up and/or glowing gear comprising: at least one item of gear; and any device or mechanism to light up or glow, e.g., at least one light, lighting system and/or glowing device, etc. The at least one light, lighting system and/or glowing device being permanently or reversibly attached to the at least one item of gear.

In another embodiment, the light-up and/or glowing gear further comprises a water-resistant/waterproof case or pocket, and at least one of the at least one light, lighting system and/or glowing devices is placed into the case or covered by the pocket prior to being attached to the at least one item of gear. The case or pocket secures the at least one light, lighting system and/or glowing devices and protects it from water.

In another embodiment, the light-up and/or glowing gear further comprises a reversible fastener for the case or pocket, the case or pocket has an opening for the at least one light, lighting system and/or glowing device. Also, the reversible fastener is for reversibly closing the opening in the case or pocket, whereby the at least one light, lighting system and/or glowing device can be serviced or replaced.

In another embodiment, the case or pocket is made of a water-resistant/waterproof material including at least one of the following: plastic, rubber, nylon, vinyl, latex, Tyvek®, neoprene, Gore-tex®, fabric treated by chemicals or otherwise treated to be waterproof/water-resistant (chemical treatments, etc.), sail fabric, canvas, oilcloth, and TPU fabrics, and other water-resistant/waterproof materials. It can be desirable for the water-resistant/waterproof material to be light colored or transparent so light/glow of the lights, shines through well.

In another embodiment, the reversible fastener is at least one of the following: snaps, straps, buckles, zipper or Ziploc® type reversible zipper, hook and loop fasteners, tape and other types of fasteners where the fastening action can be reversed, and possibly re-fastened.

In another embodiment, the at least one light, lighting system and/or glowing device is at least one of the following: fiber optics, LED lights, blinking lights, white lights, colored lights, neon-colored lights, multi-colored lights, color-changing lights, re-chargeable lights, portable lights, portable stick on lights, glow sticks or other glowing material, battery powered glow sticks/glowing material, rechargeable glow sticks/glowing material, reflectors, reflective material water resistant/waterproof lights, battery powered lights, chargeable lights, solar powered lights (and/or any other method to make item function as intended), lighting strips, lighting sticks, ropes of light (usually LED light ropes), flexible LED lights or lighting strips, submersible LED lights, LED foam sticks, clip-on LED lights, re-chargeable lights (the light can be in a water resistant or waterproof case or pocket) and other devices capable of lighting up and/or glowing.

In one embodiment, the at least one item of gear is at least one of the following items of gear for snow sports, especially for playing sports in the dark or in low visibility: snow skis (alpine, cross country, any other), snow helmets, snow ski poles, snow ski or board jackets, snow ski or board boots, hats, scarves, gloves, snow boots, snow boards, snow pants, snow bibs, snow shoes, boot or shoe snow treads, sleds, snow tubes, snow ski or board goggles, snow ski or board packs, and other snow sports gear.

In another embodiment, the at least one item of gear is at least one (item of land sports gear, any items related to land sports gear, especially for playing sports in the dark or in low visibility on land, for example, at least one of the following items for dry land sports: balls, footballs, golf balls, kick balls, baseballs, lacrosse balls, tennis balls, soccer balls, volley balls, basketballs, pickle balls, wiffle balls, inflatable balls, inflatable ball suits, cricket balls, croquet balls, billiard balls, bowling balls, hockey balls or pucks, juggling balls, ping pong balls, rugby balls, jai alai balls, squash balls, hand balls, racquet balls, lawn balls, polo balls, tether balls, shuttle cocks, helmets, lacrosse sticks, goals, frisbees (flying discs or other shapes), croquet mallets, croquet wickets, croquet stakes, jai alai scoops, tennis rackets, badminton rackets, bats, baseball bats, wiffle ball bats, cleats, sneakers, corn hole bags or boards, bean bags, hackey sack balls, bean bags, darts, dart boards, horse shoes, horse shoe stakes, skate boards, scooters, bicycles, tricycles, big wheels, gloves, golf gloves, baseball gloves, catcher's mitts, face masks, hats, baseball caps, uniforms, pinnies, running shoes, biking shoes, bowling shoes, volleyball nets, tether ball poles, pool sticks, dumb bells, weights, bar bells, weight balls and other types of land sports gear.

In another embodiment, the at least one light, lighting system or glowing device is water-resistant/waterproof, especially for water sports, and the at least one item of gear is at least one related to water sports gear, especially for engaging in water sports in the dark or in low visibility in water, for example: water polo ball, water goggles, life vests, inflatables, towables, water skis, tubes, bathing suits, bathing caps, snorkels, snorkel masks, swim fins, buoys, moorings, wake boards, paddle boards, fishing rods or gear, ropes, swim lane ropes, water ski ropes or handles, and other types of water sports gear.

In one embodiment, the light-up and/or glowing gear further comprises a power source for the at least one light, lighting system and/or glowing device, the power source being at least one of the following: battery, rechargeable battery, solar panel and other types of power sources known or yet to be invented. The power source can be activated by smart devices, solar sensor, button, switch, or other means to activate lights/glow.

In one embodiment, the at least one item of gear further comprises a groove or recess, the at least one light, lighting system and/or glowing device is attached to the groove or recess, whereby it can be embedded in the at least one item of gear, each groove or recess can hold one or more lights and/or glowing devices.

In another embodiment, the light-up and/or glowing gear further comprises at least one of the following: GPS and/or other locator device, health sensor and/or any other type of sensor, and alarm.

One embodiment of the invention is light-up and/or glowing water sports gear comprising: at least one item of water sports gear; any device or mechanism to light up or glow, e.g., at least one light, lighting system and/or glowing device;

at least one water-resistant/waterproof case or pocket, the at least one water-resistant/waterproof case or pocket holding at least one of the at least one light, lighting system and/or glowing device; and the at least one water-resistant/waterproof case or pocket being permanently or reversibly attached to the at least one item of water sports gear.

In another embodiment, the light-up and/or glowing water sports gear further comprises a reversible fastener for the case or pocket, the case or pocket having an opening for the at least one light, lighting system and/or glowing device, the reversible fastener being for reversibly closing the opening in the case or pocket, whereby the at least one light, lighting system and/or glowing device can be serviced or replaced.

In another embodiment, the case or pocket of the light-up and/or glowing water sports gear is made of a water-resistant/waterproof material including at least one of the following: plastic, rubber, nylon, vinyl, latex, Tyvek®, neoprene, Gore-tex®, fabric treated by chemicals or otherwise treated to be waterproof/water-resistant (chemical treatments, etc.), sail fabric, canvas, oilcloth, TPU fabrics and other water-resistant/waterproof materials. It can be desirable for the water-resistant/waterproof material to be light colored or transparent so light/glow of the lights, shines through well.

In another embodiment, the at least one light, lighting system and/or glowing device of the light-up and/or glowing water sports gear is at least one of the following: fiber optics, LED lights, blinking lights, white lights, colored lights, neon-colored lights, multi-colored lights, color-changing lights, re-chargeable lights, portable lights, portable stick on lights, glow sticks or other glowing material, battery powered glow sticks/glowing material, rechargeable glow sticks/glowing material, reflectors, reflective material water resistant/waterproof lights, battery powered lights, chargeable lights, solar powered lights [and/or any other method to make item function as intended.], lighting strips, lighting sticks, ropes of light [usually LED light ropes], flexible LED lights or lighting strips, submersible LED lights, LED foam sticks, clip-on LED lights, re-chargeable lights (the light can be in a water resistant or waterproof case or pocket), and other devices capable of lighting up and/or glowing.

In another embodiment of the light-up and/or glowing water sports gear, the at least one item of water sports gear is at least one (item of land water sports gear, any items related to water sports gear, especially for playing sports in the dark or in low visibility in water, for example one) of the following items for water sports: water polo ball, water goggles, life vests, inflatables, towables, water skis, tubes, bathing suits, bathing caps, snorkels, snorkel masks, swim fins, buoys, moorings, wake boards, paddle boards, fishing rods or gear, ropes, swim lane ropes, water ski ropes or handles, and other types of water sports gear.

In another embodiment, the light-up and/or glowing water sports gear further comprises a power source for the at least one light, lighting system and/or glowing device, the power source being at least one of the following: battery, rechargeable battery, and solar panel; the power source being activated by smart devices, solar sensor, button, switch (or another means to activate lights/glow).

In another embodiment of the light-up and/or glowing water sports gear, the at least one item of gear further comprises a groove or recess, the at least one light, lighting system and/or glowing device being attached to the groove or recess (then it can be embedded in the at least one item of gear, each groove or recess can hold one or more lights and/or glowing devices).

Another embodiment of the light-up and/or glowing water sports gear further comprises at least one of the following: GPS and/or other locator device, health sensor and/or any other type of sensor, and alarm.

In another embodiment of the light-up and/or glowing water sports gear, the at least one case or pocket is permanently attached by at least one of the following: waterproof adhesive, glue, heat sealing, tape or other means or permanent attachment, or the at least one case or pocket is reversibly attached by at least one of the following: snaps, straps, buckles, zipper or Ziploc® type reversible zipper, hook and loop fasteners, tape, or other means of reversible attachment, or any means of attachment to attach lighting and/or other safety items to other invention items for use.

DETAILED DESCRIPTION OF THE INVENTION

Figure 1:
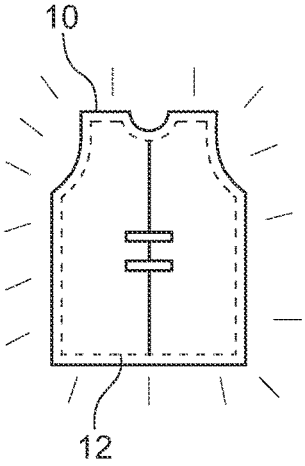
FIG. 1 depicts a life vest with lights in accordance with an embodiment of the invention.

The following definitions are used for the terms described herein:

Definitions

Gear refers to clothing, equipment or other accessories needed or used for something specific.

Light or lights refer to one or more devices that light up, one or more lights, lighting systems and/or glow devices.

Components and functions of exemplary devices will now be described with reference to the drawings. The following detailed description includes specific details in order to provide an understanding of examples of the invention. Reference is made to the accompanying drawings which form a part hereof, and in which is shown by way of illustration specific embodiments in which the invention and its components may be implemented. These embodiments are described in sufficient detail to enable those skilled in the art to practice the novel products and methods, and it is to be understood that other embodiments may be utilized and that changes may be made without departing from the spirit and scope of the teachings herein. The following detailed description is, therefore, not to be taken in a limiting sense. Reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

COMPONENTS IN THE FIGURES

Life vest 10
Lights 12
Switch/button and/or operating system 14
Phone 16
Watch 18
Computer, method or other smart device 20
Attachable light/lights, locator device, health sensor and/or any other type of sensor 22
Power source 24
Solar charger 26
Surfboard 28
Button/switch/Bluetooth/smart sensor 30
Locator and/or sensor 32
Rope 36
Handle 38
Buoy 40
Anchor rope 42
Ski/board 44
Groove/recess 46
Case or pocket 48
Case or pocket flap 50
Tape 52
Case or pocket 54
Fastener 56
Case or pocket 58
Folding indicators 60, 61
Fastening strips 62, 63

These cases/pockets 48, 54 and 58 can be made of a waterproof or water-resistant material which can be transparent or somewhat transparent and/or have a light color to allow light(s) and/or lighting system and/or glowing device 12 to shine through the material.

FIG. 1 includes an example of gear, vest 10, with lights 12. The lights 12 can be individual lights or part of a lighting system.

Figure 2:
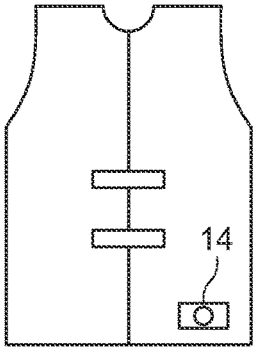
FIG. 2 depicts a vest with a switch/button and/or operating system for a light or lights in accordance with one embodiment of the invention.

FIG. 2 includes an example of an item of gear, vest 10, with a switch/button and/or operating system 14 to control at least one light, lighting system, health sensor, alarm, other type of sensor and/or GPS and/or other locator device.

Figure 3:
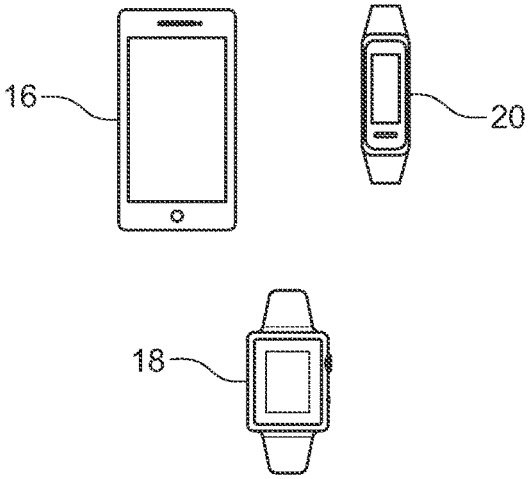
FIG. 3 depicts some examples of devices that can be used to control a lighting system and/or locator device in accordance with one embodiment of the invention.

FIG. 3 displays examples of devices which can be used to operate lights, a lighting system and/or GPS and/or other locating device. These examples include, but are not limited to a phone 16, watch 18 and/or computer, method or other smart device 20. Devices such as phone 16, watch 18 and/or computer, method or other smart device 20 can also be used to receive information from an item of gear, specifically from a GPS or other locating device, health sensor and/or other type of sensor, such as that shown in FIG. 4.

Figure 4:
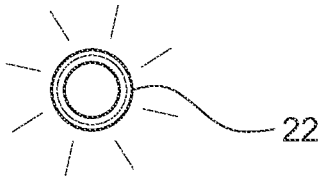
FIG. 4 depicts an example of attached or attachable light/lights, GPS and/or other locator device, alarm, health sensor and/or any other type of sensor.

FIG. 4. Includes an example of attached or attachable light/lights, GPS and/or other locator device, alarm, health sensor and/or any other type of sensor 22. An item of gear in accordance with the invention can include one or more attached or attachable light/lights, locator device, health sensor and/or any other type of sensor 22. Examples of such a locator device 22 includes GPS trackers, Tile®, and others, such as shown in U.S. Pat. No. 10,740,664, application Ser. No. 15/849,704, filed Dec. 21, 2017, issued Aug. 11, 2020, entitled WIRELESS LOW POWER FLEXIBLE AND REMOVABLY ATTACHABLE TAG AND CORRESPONDING LOCATING DEVICE, SYSTEM, AND METHOD OF USE, which is incorporated herein by reference in its entirety. These locator devices 22 can be embedded in the item of gear when the item of gear is being made or attached later in after-market sales.

Figure 5:
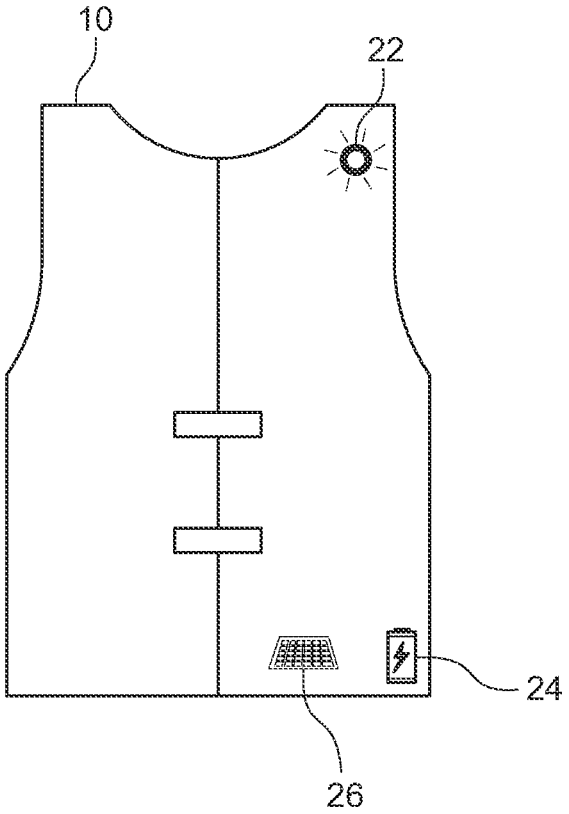
FIG. 5 depicts an example of an item of gear, specifically a vest, with an example of attached or attachable light/lights, GPS and/or other locator device, alarm, health sensor and/or any other type of sensor, as well as examples of power source and solar charger.

FIG. 5 includes an example of an item of gear, vest 10, with an example of attached or attachable light/lights, GPS and/or other locator device, alarm, health sensor and/or any other type of sensor 22, as well as examples of power source 24 and solar charger 26. Power source 24 can be chargeable, battery operated, and/or any other source of power or means to operate the attached or attachable light/lights, GPS and/or other locator device, health sensor and/or any other type of sensor 22. The example of an item of gear, vest 10, in FIG. 5 can also include a switch/button and/or operating system 14 to control at least one light, lighting system, alarm, health sensor, other type of sensor and/or locator device, such as that shown in FIG. 2.

Figure 6:
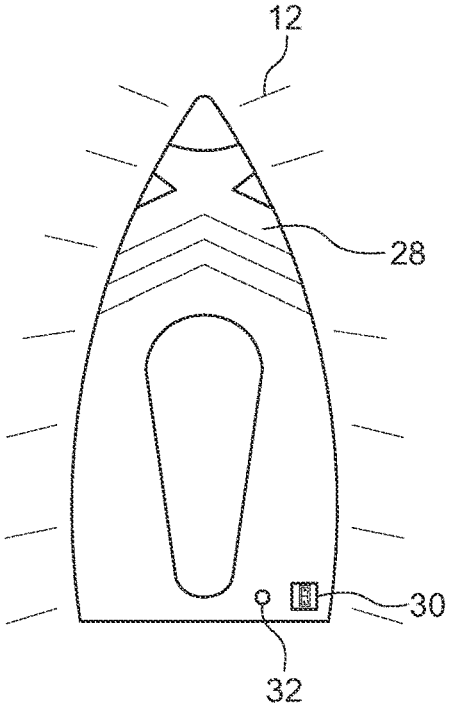
FIG. 6 depicts an example of an item of gear, specifically a surfboard with lights, an example of a button, switch, blue tooth and/or smart sensor, and an example of a locator and/or sensor that can be built into the surfboard.

FIG. 6 includes an example of an item of gear, specifically a sports item, more specifically a surfboard 28 (it is also representative of other types of sports boards, e.g., snow boards, wake boards, paddle boards, etc. The surfboard has lights 12, an example of a button, switch, blue tooth and/or smart sensor 30, and an example of a locator and/or sensor 32 that can be built into the surfboard 28.

Figure 7:
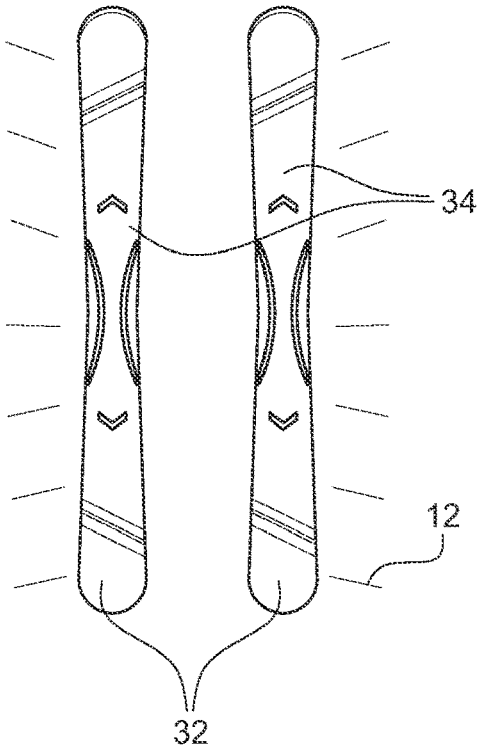
FIG. 7 depicts an example of an item of gear, specifically skis, the skis include an example of lights, an example of a button, switch, blue tooth and/or smart sensor, and an example of a locator and/or sensor that can be built into the skis.

FIG. 7 includes an example of an item of gear, specifically skis 34, such as snow skis (e.g., alpine, cross-country, etc.), water skis, etc. The skis have lights 12, an example of a button, switch, blue tooth and/or smart sensor 30, and an example of a locator and/or sensor 32 that can be built into the skis 34.

Figure 8:
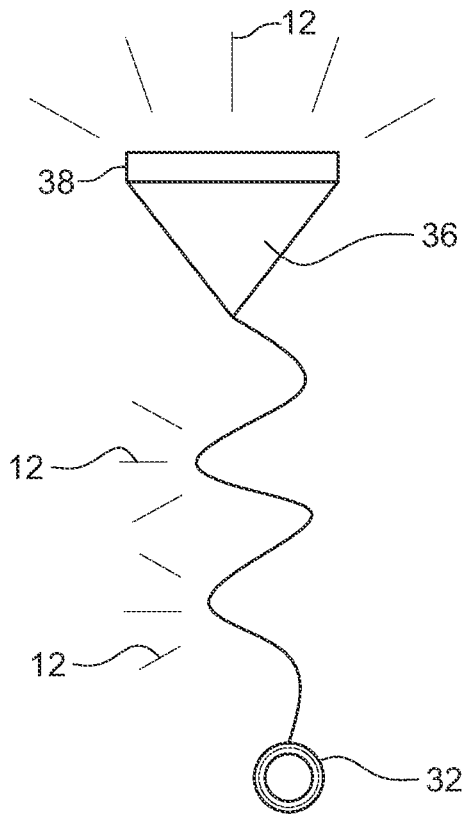
FIG. 8 depicts an example of a rope with lights.

FIG. 8 includes an example of a rope 36 with lights 12. Such ropes 36 can be used to tow a swimmer or towable, e.g., a tube, wake board, water skis, a variety of inflatables of different shapes, etc. Rope 36 is representative of any ropes and/or extensions, especially those used in sporting activities, and more specifically of ropes and/or extensions used at night or when visibility is low. In the example shown in FIG. 8 handle 38 is attached to rope 36. Handle 38 is also shown with lights 12. The handle 38 can, for example, be held by a person on water skis, or a wake board, or handle 38 can be attached to a towable, such as a tube or other-shaped inflatable.

Figure 9:
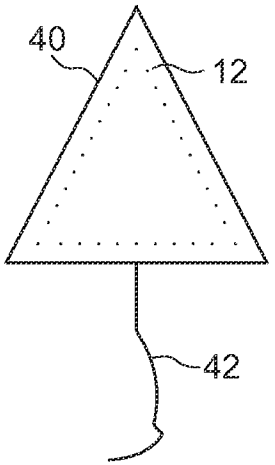
FIG. 9 depicts an example of an item of gear, specifically a buoy, which is optionally anchored with an anchor rope.

FIG. 9 includes an example of an item of gear, specifically a buoy 40, which is optionally anchored with anchor rope 42. Buoy 40 has one or more lights 12 and can also have one or more of the following (not shown): button, switch, blue tooth and/or smart sensor, a locator, GPS or otherwise, sensor for temperature, for sensing whether something is attached to the buoy, etc., alarm, health sensor and/or any other type of sensor, power source and solar charger, a switch/button and/or operating system 14 to control at least one light, lighting system, health sensor, alarm, other type of sensor and/or GPS and/or other locator device.

Figure 10:
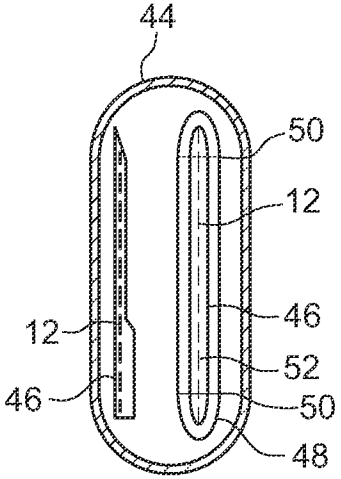
FIG. 10 depicts an example of an item of gear, specifically a board.

FIG. 10 includes an example of an item of gear, specifically a board 44, e.g., skis, surfboard, wake board, paddle board, snow board, etc. In the figure, board 44 includes grooves/recesses 46 having one or more lights or lighting systems 12. Board 44 can also have a case or pocket 48 which can be waterproof/water resistant and can be placed over at least one light 12 whether or not the at least one light 12 is in a groove/recess. The case or pocket 48 can be an enclosed case or pocket located in groove/recess 46 or it can be a covering case or pocket which is placed over the at least one light or lighting system 12, which is in groove/recess 46, and then attached to groove/recess 46 and or board 44. The case or pocket 48 can be attached by any type of fastening mechanism, e.g., a permanent fastening mechanism, e.g., glue, heat sealing, tape, etc., or a reversible fastening mechanism, e.g., snaps, zipper or Ziploc® type reversible zipper or hook and loop fasteners, such as Velcro®, etc. Tape 52 can be used to close flap 54 over an opening in case or pocket 48 for the at least one light or lighting system 12 to be serviced or replaced. There can be one or more openings covered by flap 54 (two are shown at either end of case or pocket 48). Additionally, flap 54 can be used to cover an opening along the length of case or pocket 48. Tape 52 can be used in addition to or as an alternative to flap 54 or another type of seal, e.g., snaps, zipper or Ziploc® type reversible zipper or hook and loop fasteners, such as Velcro®, etc.

Figure 11:
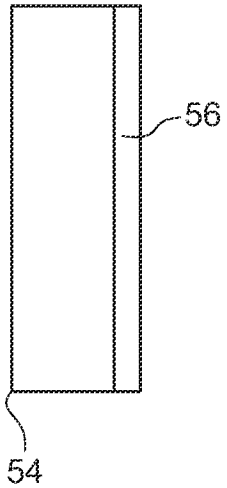
FIG. 11 depicts an example of a case or pocket for holding the at least one light, lighting system and/or glowing device so that it can be kept water-resistant/waterproof and still be serviced or replaced.

FIG. 11 includes an example of case or pocket 54, which can be a waterproof/water resistant pocket. Case or pocket 54 can include fastener 56, which can be a permanent fastener, e.g., glue, heat sealed section, tape, etc., or a reversible fastener such as zipper or Ziploc® type reversible zipper or hook and loop fasteners, such as Velcro®, etc.

Figure 12:
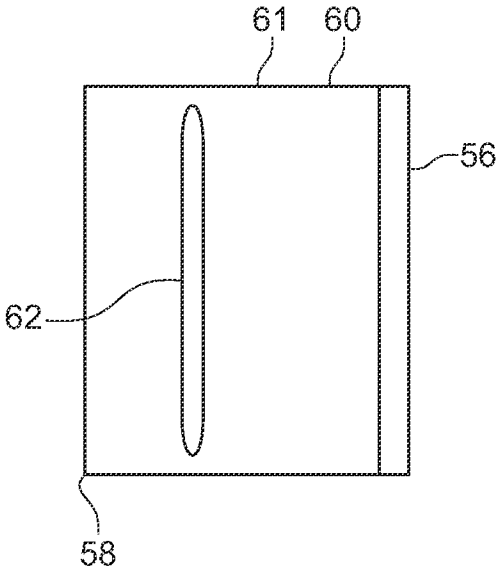
FIG. 12 depicts another example of a case or pocket for holding the at least one light, lighting system and/or glowing device so that it can be kept water-resistant/waterproof and still be serviced or replaced.

FIG. 12 includes an example of case or pocket 58 for holding the at least one light or lighting system 12 to be serviced or replaced. Case or pocket 58 can be a waterproof/water resistant pocket. Additionally, case or pocket 58 can include fastener 56, which can be a permanent fastener, e.g., glue, heat sealed section, tape, etc., or a reversible fastener such as zipper or Ziploc® type reversible zipper or hook and loop fasteners, such as Velcro®, etc.

The water tightness of the fastener 56 can be improved by folding it over on top of case pocket 58 using folding indicators 60, 61. When fastener 56 is folded over at folding indicator 60 towards fastener strip 62, one can view another fastener strip 63 (not shown, but same or similar to fastener strip 62 and fastening to fastener strip 62), which is located on the reverse side of the case pocket 58 shown in FIG. 12. Then, when case pocket 58 together with fastener 56 and fastener strip 63 is folded over at folding indicator 61 towards fastener strip 62, then fastener strip 62 can be fastened to fastener strip 63. Fastener strips 62, 63 are re-fastenable fastening devices such as a zipper or Ziploc® type reversible zipper or hook and loop fasteners, such as Velcro®, snaps, releasable double-sided tape, and other re-fastenable fastening devices now known or to be invented, so that the opening in case/pocket 58 at fastener 56 is better protected from water entering therein and damaging the at least one light or lighting system 12.

Fastener strips 62 and 63 can be in the form of a single fastening strip, as shown or can be in the form of several strips (in the shape of a strip or other shapes, e.g., circles, ovals, squares, etc. When there is more than one fastening strip in place of single fastening strips 62, 63, they should be placed so that the fastening strips in place of single fastening strip 62 lines up with the at least one fastening strip in place of single fastening strip 63, so that the folded over section can be secured. The fastener strips 62, 63 are made using reversible fasteners so that the lights in the case or pocket can be accessed for service or replacement.

Any currently known gear or technology utilized in the present invention includes gear or technology currently known and/or discovered in the future.

The present invention is especially useful for any night-time or low light sports activities so that an item of gear and/or the person wearing and/or using the item of gear can be more easily found. The user can be found by being spotted by the light(s) or lighting system 12, the locators, sensors 22/32. Additionally, the user can be found by signaling others using the light(s) or lighting system 12, the locators, sensors 22/32.

The invention may or may not include one or more of the following safety items: lights, glowing devices, locator device and or capabilities, safety alarm, solar technology, solar power for powering the safety items, fiber optic thread that lights up, batteries, charging station and or chargeable capabilities, blue tooth capabilities, software, control switches and/or buttons, health detectors and/or sensors, drowning or sinking detection and/or monitoring capabilities, detection, monitoring capabilities, reflectors, touch sensors, turnsignals, and/or any device, mechanism or means to make an item light-up and/or glow.

Safety items include lighting items.

Invention items include but are not limited to these items: any or all types life safety vests, floatation devices, wake surfing boards, surf boards, wake boards, water skis, snow skis, snow boards, balls, boating ropes for water sports, separating swim lanes and/or boat tie up, tubes, floats, floaties, helmets, clothing, shoes, socks, boots, equipment, paddle boards, paddles, uniforms, swim wear, clothing, pucks, clubs, watches, accessories, gloves, mats, hats, sports glasses, goggles etc.

Other lighting items may be any type of light, lights, or lighting system used, including but not limited to LED and/or fiber optics.

These lighting items may or may not have color changing technology.

Lighting items and/or other safety items may be manufactured into, added onto, and/or attached to for use with invention items.

Examples of the attachable method can include inserting lighting and/or other safety items into other invention items and/or using waterproof adhesive, glue, tape, snaps, straps, Velcro®, buckle, or any means of attachment to attach lighting and/or other safety items to other invention items for use. a permanent fastener, e.g., glue, heat sealed section, tape, The lighting and/or other safety items may or may not be waterproof, breathable, heat-resistant.

The lighting and/or other safety items may be battery powered, chargeable, solar powered and/or any other method to make item function as intended.

Items capable of lighting up and/or glowing include at least the following: LED lights, lighting strips, stick, ropes, etc., flexible LED lights and lighting strips, submersible LED lights, LED foam sticks, clip-on LED lights, battery powered lights and LED lights, re-chargeable lights and LED lights, portable lights, portable stick on lights, glow sticks or other glowing material, battery powered glow sticks/glowing material, including LEDs, rechargeable glow sticks/glowing material, including LEDs, reflectors, reflective material is also included, any of the lights can be water resistant/waterproof and/or have water resistant/waterproof (the light can be in a water resistant or waterproof case or pocket).

The lights can be white lights, colored lights, neon-colored lights, multi-colored lights, color-changing lights, etc.

The items capable of lighting up and/or glowing can be enclosed in object, fabric, etc. or covered on top, or otherwise, case/pocket can be fully enclosed case attached to gear or in the form of a covering which covers the at least one light or glowing device and is permanently or reversibly fastened to the gear by a fastening device.

Additional embodiments of the invention can include Sports or recreational items made with one or more safety features to allow a person and/or item more safety protection features when participating in a sport or recreational activity. Features include one or more of the following:

A. Invention item will light up for night sports and/or recreational activities at night allowing person or item to be seen by others. May use any type of light, lights, or lighting system. including but not limited to: LED and/or fiber optics.

B. Invention item may have chip, locator, or trackable device capabilities.

C. Invention item may have a safety alarm.

D. Invention item may have detector, sensor, monitor, and/or any other way to detect sinking, drowning, and/or health concerns such as heart rate, blood pressure and/or any other medical issue.

E. Invention item may have blue tooth technology.

F. Invention may have Software compatibility.

G. Invention may be accessed through it's app, phone, any smart device, and/or any other means needed to function properly.

H. Invention may have charging capabilities and/or charging stations.

I. Invention may be battery operated, chargeable, solar powered, and/or any other method to make item function as intended.

J. Invention may or may not have color changing and/or blinking lights.

Invention items (with one or more safety feature), include, but are not limited to: all sports items, life safety vests, floatation devices, wake surfing boards, surf boards, wake boards, water skis, snow skis, snow boards, ropes for any water sport, tow ropes, tie ropes, tubes, floats, floaties, helmets, skate boards, long boards, paddle boards, sail boats, water crafts, kayaks, jet skis, paddles, boats, balls, pucks, clubs, uniforms, swim wear, clothing, watches, accessories, gloves, shoes, boots, mats, hats, glasses, goggles, watches, wrist bands, fishing rods.

Invention item's features may by manufactured into, added onto, and or attachable.

The attachable method may or may not be attached by inserting into item and/or using waterproof adhesive, glue, snaps, straps, Velcro, or any other means to be attached for use.

Invention items may or may not be waterproof, breathable, heat resistant.

Lights include fiber optics or any means to light up and/or glow.

The lights may or may not be solar powered/battery operated, or have any means to charge/power the light, including new technology, Ike self-charging battery operated light known as eBulb/used with or without smart device and/or tracking system, implanted or attached to the gear.

Although preferred embodiments of the present invention have been described herein it will be understood by those skilled in the art that the present invention should not be limited to the described preferred embodiments. Rather, various changes and modifications can be made within the spirit and scope of the present invention.

All of the material in these patent application documents are subject to copyright protection under the copyright laws of the United States and other countries. The copyright owner has no objection to the facsimile reproduction by anyone of the patent application documents, as it appears in official governmental records but, otherwise, all other copyright rights whatsoever are reserved.

What is claimed is:

1. Light-up gear comprising: at least one board; at least one LED rope light; and at least one water-resistant pocket, at least one of the at least one LED rope lights being placed in the at least one water-resistant pocket, and the at least one water-resistant pocket being reversibly attached to the at least one board.

2. The light-up gear of claim 1, further comprising at least one snap for the at least one pocket, the at least one pocket having an opening for the at least one LED rope light, the at least one snap being for reversibly closing the opening in the at least one pocket, whereby the at least one LED rope light can be serviced or replaced; and wherein the at least one pocket is made of a water-resistant material.

3. The light-up gear of claim 1, wherein the at least one LED rope light includes at least one of the following: blinking lights, white lights, colored lights, neon-colored lights, multi-colored lights, color-changing lights, portable lights, portable stick on lights, chargeable lights, solar powered lights, submersible LED lights, clip-on LED lights, and re-chargeable lights.

4. The light-up gear of claim 1, wherein the at least one board is for snow sports.

5. The light-up gear of claim 1, wherein the at least one board is for dry land sports.

6. The light-up gear of claim 1, wherein the at least one LED rope light is water-resistant, and the at least one board is for water sports.

7. The light-up gear of claim 1, further comprising a power source for the at least one LED rope light; the power source being activated by smart devices, solar sensor, button, or switch.

8. The light-up gear of claim 1, wherein the at least one board further comprises an elongated groove or recess on the surface of the board, the at least one pocket being attached to the groove or recess.

9. The light-up gear of claim 1, further comprising at least one of the following: GPS or other locator device.

10. The light-up gear of claim 1, further comprising at least one of the following: health sensor or alarm.

11. The light-up gear of claim 1, wherein the pocket is light colored or transparent so the at least one LED rope light shines through.

12. Light-up gear comprising:

at least one LED rope light and a pocket to hold the at least one LED rope light and reversibly attach it to at least one board, the pocket being light colored or transparent so the at least one LED rope light shines through;

and a power source for the at least one LED rope light.

13. The light-up gear of claim 12, further comprising the power source being activated by smart devices, solar sensor, button, or switch.

14. The light-up gear of claim 12, wherein the at least one board has a groove or recess, and the pocket is in the groove or recess.

15. The light-up gear of claim 12, wherein the at least one LED rope light includes at least one of the following: blinking lights, white lights, colored lights, neon-colored lights, multi-colored lights, color-changing lights, portable lights, portable stick on lights, chargeable lights, solar powered lights, submersible LED lights, clip-on LED lights, and re-chargeable lights.

16. The light-up gear of claim 12, further comprising at least one of the following: GPS or other locator device.

17. The light-up gear of claim 12, further comprising at least one snap for the pocket, the pocket having an opening for the at least one LED rope light, the at least one snap being for reversibly closing the opening in the pocket, whereby the at least one LED rope light can be serviced or replaced; and wherein the pocket is made of a water-resistant material.

18. The light-up gear of claim 12, further comprising at least one of the following: health sensor or alarm.

* * * * *